US007766175B2

(12) United States Patent
Jadhav et al.

(10) Patent No.: US 7,766,175 B2
(45) Date of Patent: Aug. 3, 2010

(54) SHELF ACCESSORY FOR A DISHWASHER RACK

(75) Inventors: Ashwin Jadhav, New Bern, NC (US); Kent Crookshanks, Anderson, SC (US); Michael Bryan Pike, Kinston, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 239 days.

(21) Appl. No.: 11/937,773

(22) Filed: Nov. 9, 2007

(65) Prior Publication Data

US 2009/0120883 A1 May 14, 2009

(51) Int. Cl.
*A47G 19/08* (2006.01)
*B08B 3/00* (2006.01)

(52) U.S. Cl. ..... 211/41.9; 314/135

(58) Field of Classification Search ..... 211/41.14, 211/41.4, 41.5, 41.6, 41.8, 41.9, 70.7, 85, 211/88.01, 90.01, 90.03, 126.1, 126.2, 126.8, 211/126.9, 133.5, 168, 181.1, 184, 198; 134/25.2, 135, 200, 201; 220/487, 488; 248/37.3, 37.6, 175, 214, 215, 249, 250, 248/211, 225.21, 302, 303; 312/311; D32/3
See application file for complete search history.

(56) References Cited

U.S. PATENT DOCUMENTS 1,282,094 A * 10/1918 Lindner ..... 220/485
1,426,787 A * 8/1922 Spencer ..... 297/411.22
1,493,948 A * 5/1924 Apple ..... 220/491
1,546,972 A * 7/1925 Denniston ..... 248/237
1,691,858 A * 11/1928 Ryerson ..... 220/487
2,516,088 A * 7/1950 Einhorn ..... 211/41.5
2,586,005 A * 2/1952 Colonna ..... 220/487
2,708,037 A * 5/1955 Planeta ..... 211/74
2,793,761 A * 5/1957 Geralds ..... 211/59.1
3,295,471 A * 1/1967 Cook ..... 108/163
3,355,134 A * 11/1967 Chesley ..... 248/250
3,451,556 A * 6/1969 Macoicz ..... 211/41.9
3,752,322 A * 8/1973 Fiocca et al. ..... 211/41.8
3,896,766 A * 7/1975 Martin ..... 119/474
3,915,097 A * 10/1975 Young, Jr. ..... 108/6

(Continued)

FOREIGN PATENT DOCUMENTS

DE 3135458 A1 * 3/1983

(Continued)

*Primary Examiner*—Darnell M Jayne
*Assistant Examiner*—Joshua Rodden
(74) *Attorney, Agent, or Firm*—Alston & Bird LLP

(57) ABSTRACT

A shelf accessory for a dishwasher rack is provided, comprising a spine extending in parallel with a structural member of the rack. A plurality of loops extends perpendicularly from the spine, and the loops are spaced apart in relation to each other along the spine, and cooperate therewith to define a shelf member. A clip member is operably engaged between the shelf member and the structural member, and is configured to be capable of rotating about the structural member such that the shelf member correspondingly orbits about the structural member. The clip member further comprises at least one retention member operably engaged therewith. The at least one retention member is configured to cooperate with the rack so as to retain and support the shelf member in at least one of a plurality of angular positions with respect to and about the structural member. Associated apparatuses are also provided.

11 Claims, 7 Drawing Sheets

U.S. PATENT DOCUMENTS

| | | | | | |
|---|---|---|---|---|---|
| 3,925,014 | A | * | 12/1975 | Langdon | 422/310 |
| 3,934,728 | A | * | 1/1976 | Guth | 211/41.9 |
| 4,046,261 | A | * | 9/1977 | Yake | 211/41.8 |
| 4,245,746 | A | * | 1/1981 | Aylor | 211/40 |
| 4,606,464 | A | * | 8/1986 | Jordan et al. | 211/41.8 |
| 4,726,475 | A | * | 2/1988 | Ferenzi | 211/41.5 |
| 4,830,200 | A | * | 5/1989 | Zambano et al. | 211/133.5 |
| 4,865,821 | A | * | 9/1989 | Langdon | 422/300 |
| 4,917,248 | A | * | 4/1990 | Friskney | 211/41.8 |
| 5,103,799 | A | * | 4/1992 | Atanasio | 126/9 R |
| 5,158,185 | A | * | 10/1992 | Michael et al. | 211/41.8 |
| 5,205,419 | A | * | 4/1993 | Purtilo | 211/41.8 |
| 5,249,590 | A | * | 10/1993 | Jacobus et al. | 134/135 |
| 5,344,029 | A | * | 9/1994 | Oghia et al. | 211/41.8 |
| 5,351,837 | A | * | 10/1994 | Smith | 211/41.8 |
| 5,449,076 | A | * | 9/1995 | Van Noord | 211/59.3 |
| 5,480,035 | A | * | 1/1996 | Smith | 211/41.8 |
| 5,588,543 | A | * | 12/1996 | Finger | 211/90.01 |
| 5,601,195 | A | * | 2/1997 | Finola et al. | 211/41.8 |
| 5,947,433 | A | * | 9/1999 | Klein | 248/214 |
| 6,571,965 | B1 | * | 6/2003 | Beck et al. | 211/41.8 |
| 6,758,355 | B2 | * | 7/2004 | Zidek | 211/205 |
| 6,848,585 | B2 | * | 2/2005 | VanLandingham | 211/41.9 |
| D516,757 | S | * | 3/2006 | Hedstrom et al. | D32/3 |
| D518,615 | S | * | 4/2006 | Yang et al. | D32/55 |
| D518,936 | S | * | 4/2006 | Yang et al. | D32/55 |
| 7,032,604 | B2 | * | 4/2006 | Welch | 134/135 |
| 7,228,975 | B2 | * | 6/2007 | Yang et al. | 211/41.4 |
| 7,231,929 | B2 | * | 6/2007 | Landsiedel et al. | 134/135 |
| 7,455,184 | B2 | * | 11/2008 | Yang et al. | 211/41.4 |
| 7,543,712 | B2 | * | 6/2009 | Purushothaman | 211/41.9 |
| 7,644,826 | B2 | * | 1/2010 | Koch et al. | 211/41.4 |
| 7,665,475 | B2 | * | 2/2010 | Hedstrom et al. | 134/134 |
| 7,690,517 | B2 | * | 4/2010 | Purushothaman et al. | 211/41.8 |
| 2003/0205259 | A1 | * | 11/2003 | McConnell et al. | 134/138 |
| 2005/0016941 | A1 | * | 1/2005 | Neff et al. | 211/41.9 |
| 2005/0236344 | A1 | * | 10/2005 | Yang et al. | 211/41.4 |
| 2005/0242046 | A1 | | 11/2005 | Lee | |
| 2005/0268945 | A1 | * | 12/2005 | Hedstrom et al. | 134/25.2 |
| 2006/0138064 | A1 | | 6/2006 | Crudgington, Jr. | |
| 2006/0237042 | A1 | * | 10/2006 | Weaver et al. | 134/25.2 |
| 2006/0237379 | A1 | * | 10/2006 | Yang et al. | 211/41.4 |
| 2007/0039904 | A1 | | 2/2007 | Purushothaman | |
| 2007/0039905 | A1 | | 2/2007 | Purushothaman | |
| 2007/0131696 | A1 | | 6/2007 | Schessl et al. | |
| 2007/0199584 | A1 | * | 8/2007 | Koch et al. | 134/135 |
| 2007/0247039 | A1 | * | 10/2007 | Anderson et al. | 312/228.1 |
| 2008/0083678 | A1 | * | 4/2008 | Graute | 211/41.8 |
| 2008/0110480 | A1 | * | 5/2008 | Choi et al. | 134/135 |
| 2008/0116155 | A1 | * | 5/2008 | Yang et al. | 211/41.3 |
| 2008/0135505 | A1 | * | 6/2008 | Frankel et al. | 211/41.4 |
| 2008/0185352 | A1 | * | 8/2008 | O'Hara | 211/13.1 |
| 2008/0302740 | A1 | * | 12/2008 | Moser et al. | 211/41.8 |
| 2009/0050585 | A1 | * | 2/2009 | Lindgren et al. | 211/70.7 |

FOREIGN PATENT DOCUMENTS

| | | | | |
|---|---|---|---|---|
| DE | 44 37 472 | A1 | | 4/1996 |
| DE | 94 21 847 | U1 | | 12/1996 |
| DE | 202 18 588 | U1 | | 4/2004 |
| DE | 20 2005 000915 | U1 | | 4/2005 |
| EP | 0 937 436 | A1 | | 8/1999 |
| EP | 1 275 336 | A1 | | 1/2003 |
| EP | 1275336 | A1 | * | 1/2003 |
| EP | 1475030 | A2 | * | 11/2004 |
| EP | 2025281 | | * | 10/2007 |
| WO | WO 01/87133 | A1 | | 11/2001 |
| WO | WO 2005/037050 | A1 | | 4/2005 |
| WO | WO 2007104430 | A1 | * | 9/2007 |

* cited by examiner

SHELF ACCESSORY FOR A DISHWASHER RACK

BACKGROUND OF THE INVENTION

1. Field of the Invention

The present disclosure relates to dishwashers and, more particularly, to a shelf accessory for a dishwasher rack.

2. Description of Related Art

A dishwasher typically includes upper and lower wire racks for holding, for example, dishware, glassware, or cookware. Often, the upper rack is particularly configured for receiving glassware. However, the variety of glassware configurations makes it difficult to provide a rack capable of universally accommodating glassware, while maximizing rack capacity. That is, glassware configurations may range, for example, from relatively tall wine glasses/champagne flutes having long stems, to relatively short highball glasses.

Such glassware tends to encompass a particular area. That is, the diameter of each glass is usually within a certain range, which can be used to determine, for example, tine spacing in the rack. However, while that factor may allow the usable area of the rack to be optimized, the varying heights of the glassware means that the vertical space of the rack may not be fully utilized if relatively short glassware is being washed. In addition, it is generally preferable to have the rack configured to be as "open" as possible, without extraneous structures occupying rack space.

Thus, there exists a need for a dishwasher rack capable of accommodating dishware having various configurations, while allowing the capacity thereof to be more efficiently utilized.

BRIEF SUMMARY OF THE INVENTION

The above and other needs are met by the present disclosure which, in one embodiment, provides a shelf accessory configured to engage a dishwasher rack. Such a shelf accessory comprises a spine adapted to extend in parallel with a structural member of the rack. A plurality of loops is engaged with the spine and each extends perpendicularly therefrom. The loops are spaced apart in relation to each other along the spine and cooperate therewith to define a shelf member. A clip member is operably engaged between the shelf member and the structural member of the rack, and is configured to be capable of rotating about the structural member such that the shelf member correspondingly orbits about the structural member. The clip member further comprises at least one retention member operably engaged therewith. The at least one retention member is configured to cooperate with the rack so as to retain and support the shelf member in at least one of a plurality of angular positions with respect to and about the structural member.

Another advantageous aspect of the present invention comprises an appliance including a rack adapted to receive and support dishware therein, wherein the rack includes at least one laterally-extending structural member. A shelf accessory is capable of operably engaging the at least one laterally-extending structural member, and the shelf accessory comprises a spine, a plurality of loops, and a clip member. The spine is adapted to extend in parallel with a structural member of the rack. A plurality of loops is engaged with the spine and each extends perpendicularly therefrom. The loops are spaced apart in relation to each other along the spine and cooperate therewith to define a shelf member. A clip member is operably engaged between the shelf member and the structural member of the rack, and is configured to be capable of rotating about the structural member such that the shelf member correspondingly orbits about the structural member. The clip member further comprises at least one retention member operably engaged therewith. The at least one retention member is configured to cooperate with the rack so as to retain and support the shelf member in at least one of a plurality of angular positions with respect to and about the structural member.

Thus, the shelf accessory and appliance, as disclosed in conjunction with various embodiments of the present disclosure, provide many advantages that may include, but are not limited to, accommodating glassware, dishware, or cookware having various configurations by providing a plurality of discrete shelf positions for more efficiently utilizing the capacity of the dishwasher rack.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE INVENTION

The present disclosure now will be described more fully hereinafter with reference to the accompanying drawings, in which some, but not all embodiments of the disclosure are shown. Indeed, this disclosure may be embodied in many different forms and should not be construed as limited to the embodiments set forth herein; rather, these embodiments are provided so that this disclosure will satisfy applicable legal requirements. Like numbers refer to like elements throughout.

Figure 1:
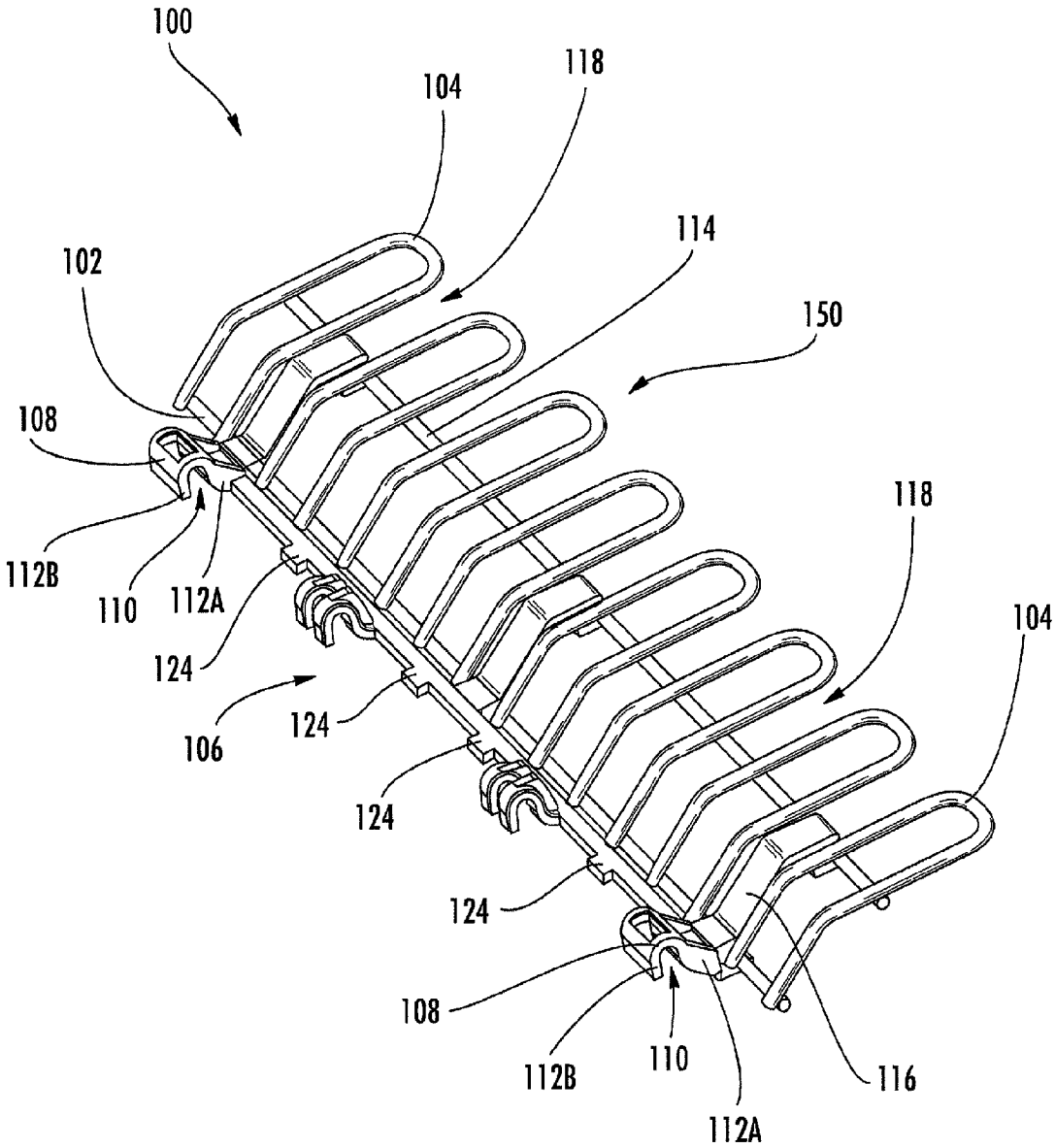
FIG. 1 illustrates a perspective view of a shelf accessory for a dishwasher according to one embodiment of the present disclosure.

In accordance with the present disclosure, a dishwasher appliance may comprise a dishwasher rack adapted to receive and support dishware therein, the dishwasher rack including at least one laterally-extending structural member, as will be appreciated by one skilled in the art. As used herein, the term dishware is intended to encompass dishware, glassware (including stemware), cookware, or any other kitchen utensils that may be disposed in a dishwasher appliance for washing, and the use of such a term herein is not intended to be limiting in the regard. As illustrated in FIG. 1, the dishwasher appliance may further comprise a shelf accessory, generally designated 100, capable of operably engaging the at least one laterally-extending structural member of the rack. Advantageously, shelf accessory 100 may be configured so as to facilitate more efficient use of the limited space provided by the dishwasher rack for holding dishware, by offering a plurality of discrete angular positions at which shelf accessory 100 may be retained. By providing such discrete angular positions at which the shelf accessory 100 can be retained, one of which may include a storage position in which the shelf accessory 100 is relatively unobtrusive with respect to the rack, dishware may be supported or stacked within the dishwasher rack to better utilize the space provided by the overall configuration thereof.

For example, shelf accessory 100 may be retained in a substantially vertical stowed or storage position with respect to the structural member of the dishwasher rack so as not to protrude or minimally protrude into the "open" or dishware-receiving space defined thereby, thus permitting reception of tall dishware, glassware, or cookware therewithin with minimal or no hindrance. In one aspect, the shelf accessory 100 may be configured to minimize the volume of the rack occupied thereby. For example, portions of the shelf accessory 100 may be configured to fit between structural components of the rack, or otherwise outside of the rack boundaries, when the shelf accessory 100 is disposed in the storage position. In another aspect, as further disclosed herein, the shelf accessory 100 may be configured to be removable from the rack so as to maximize access to the available rack volume.

Furthermore, as an example, shelf accessory 100 may also be retained in a substantially horizontal deployed position with respect to the structural member of the dishwasher rack. According to one aspect, the substantially vertical stowed or storage position and the substantially horizontal deployed position may represent the opposing limits of the discrete angular positions of which the shelf member 100 may be disposed about the structural member of the rack. In any instance, the shelf member 100 in the deployed position may allow, for example, stacking of dishware, such as short highball glasses, in a tiered configuration (i.e., one tier disposed within the rack, and another tier supported above the rack tier by the shelf member 100) to more efficiently use the available volume within the rack. In some instances, shelf accessory 100 may also be secured or otherwise retained at one or more intermediate angled positions between the substantially vertical stowed position and the substantially horizontal deployed position. In such an intermediate angled position, the shelf accessory 100 may be further configured, for example, to support and accommodate stemware, such as tall wine glasses/champagne flutes having long stems, as further disclosed herein.

According to some embodiments of the present disclosure, as illustrated in FIG. 1, shelf accessory 100 may be adapted to accommodate dishware in an upper dishwasher rack. One skilled in the art will appreciate that such a dishwasher rack may be formed of a plurality of intersecting wire members so as to generally define an open container configured to allow the dishwashing fluid to pass freely therethrough. In this regard, aspects of the present invention contemplate that the shelf accessory 100 disclosed herein is adapted to cooperate with at least one of the wire members of the rack, otherwise referred to herein as a structural member. In one aspect, the shelf accessory 100 is particularly configured to cooperate with a substantially horizontally disposed structural member of the rack, though other configurations involving vertical or otherwise angled structural members are considered to be within the spirit and scope of the embodiments of the present invention.

Shelf accessory 100 may generally comprise a spine 102, a plurality of loops 104 (the spine 102 and the loops 104 cooperating to form, for instance, a shelf member, as will be appreciated by one skilled in the art wherein, in some instances, the shelf member may be constructed of wire members similarly to the rack), and a clip member, generally designated 106. Clip member 106 may operably engage the structural member of the dishwasher rack. For example, in some embodiments, clip member 106 may comprise at least one securement member 108 configured to engage the structural member. Securement member 108 may comprise an open channel 110 defined by opposing and spaced apart leg members 112A, 112B configured to receive and secure the structural member therebetween such that clip member 106 is rotatable thereabout. For example, in some instances, the leg members 112A, 112B may be configured to as to provide a "snap" retaining mechanism therebetween, which allows the clip member 106 to be "snapped" onto and retained by the structural member of the rack, but otherwise allows the clip member 106 to rotate thereabout. Clip member 106 may extend from the structural member (in one instance, generally perpendicular with respect to the structural member) and may be configured to engage spine 102 of shelf accessory 100. For example, one leg member 112A may extend to and engage spine 102 so as to form a connection or other retaining relation therebetween. In some embodiments, clip member 106 may be configured to operably engage spine 102 such that spine 102 is secured to and substantially immobile with respect to clip member 106. For example, clip member 106 may comprise at least one retention clip 110 configured to secure spine 102 to clip member 106, for instance, by a snap mechanism defined thereby. Clip member 106 may also extend from the structural member to engage a reinforcing member 114 spaced apart from and extending substantially parallel to spine 102, wherein such a reinforcing member 114, as further discussed herein, may also be engaged with the loops 104, for example, for maintaining the spaced-apart relation of the loops 104 along the spine 102. In such instances, the clip member 106 may further comprise at least one retention member 116 operably engaged with the reinforcing member 114 so as to form a connection or other retaining relation therebetween, as described further herein.

With continuing reference to FIG. 1, loops 104 may engage spine 102 and extend perpendicularly therefrom, with loops 104 being spaced apart in relation to each other longitudinally along spine 102 and cooperating therewith to define a shelf member, generally designated 150. Accordingly, clip member 106 may be operably engaged between shelf member 150 and the structural member of the dishwasher rack for retaining the shelf member 150 with respect thereto while allowing the shelf member 150 to be capable of rotating about the structural member. In such instances, the shelf member 150 may thus be configured to correspondingly orbit about the structural member as the clip member 106 rotates thereabout. Additionally, shelf member 150 may further include one or more reinforcing members 114 configured to intersect and engage loops 104 so as to, for example, maintain the spaced-apart relation therebetween and/or facilitate structural robustness of the shelf member 150. According to some embodiments, for example, when loops 104 comprise a metal wire material, loops 104 may be substantially elongate and attached to both spine 102 and reinforcing member 114 by spot welds or any other suitable fastening or securing mechanism.

In such embodiments, loops 104 may operably engage spine 102 and reinforcing member 114 in a spaced apart manner so as to define a plurality of channels between adjacent loops 104, the channels being generally designated by the numeral 118. That is, for example, reinforcing member 114 and an adjacent pair of loops 104 may cooperate to define an open channel. In instances of the shelf member 150 being disposed in an intermediate angled position, as previously discussed, one or more of the channels 118 defined by the shelf member 150 may be configured to receive the stem of an item of stemware, such as a wine glass or champagne flute. In such instances, the shelf member 150 and channel 118 may entirely support the item of stemware, or the shelf member 150/channel 118 may provide lateral support/retention of the item of stemware which is otherwise supported by the rack. Further, in some embodiments, loops 104 may be shaped so as to substantially conform to the side wall structure of the dishwasher rack, for facilitating the unobtrusiveness of the shelf member 150 when shelf member 150 is in the substantially vertical stowed or storage position with respect to the rack. In the event of the loops 104 being shaped in correspondence with a side wall structure of the rack, the loops 104 preferably cooperate to define a substantially planar structure for the shelf member 150, at least when the shelf member 150 is disposed in the substantially horizontal deployed position.

As illustrated in FIGS. 2-7, shelf accessory 100 may be configured to operably engage a structural member such as, for example, a substantially horizontal wire member associated with a side wall 202 of a dishwasher rack 200. Side wall 202 may include one or more laterally extending (i.e., substantially horizontal) structural members 204, wherein, in one instance, a structural member 204 may be disposed medially along the height of a side wall 202 of dishwasher rack 200 (i.e., about mid-way along the height of dishwasher rack 200). According to one aspect, the clip member 106 may be configured to be capable of being engaged with the structural member 204 via the at least one securement member 108, as previously discussed. In so engaging the structural member 204, the clip member 106 is capable of rotating with respect thereto. Since the clip member 106 is configured to otherwise engage the shelf member 150, the shelf member 150 thereby becomes capable of being adjusted to various angular positions with respect to the structural member 204, as the clip member 106 is rotated about the structural member 204.

More particularly, the clip member 106 may be configured to be attached to the structural member 204, via the at least one securement member 108, and to be rotated thereabout to adjust the shelf member 150 to a plurality of discrete angular positions with respect to the structural member 204 of the side wall 202. In order to retain the shelf member 150 at any of a plurality of discrete rotational positions with respect to the structural member 204, the clip member 106 may further comprise at least one retention member 116 operably engaged therewith. The at least one retention member 116 may be configured, according to some embodiments, to cooperate with dishwasher rack 200 so as to retain and support shelf member 150 in a particular rotational position with respect to the structural member 204, and thus the side wall 202. In one instance, the at least one retention member 116 may be engaged with the at least one securement member 108 so as to extend laterally outward therefrom. For example, in one instance, a plurality of retention members 116 may be utilized, wherein each of leg members 112A, 112B may include at least one of the plurality of retention members 116 disposed on a laterally-oriented surface thereof, respectively. Accordingly, each of the at least one of the plurality of retention members 116 extends substantially parallel with the structural member 204. In order to retain the shelf member 150 in a desired rotational position, each of the at least one retention member 116 is adapted to, in one instance, engage a laterally-adjacent member of the rack (i.e., a rack member that intersects, but is not disposed parallel to, the structural member 204), as clip member 106 is rotated about the structural member 204.

In one instance, the at least one retention member 116 may comprise, for example, a first retention member 120 extending from one leg member 112A, and a second retention member 122 extending from the other leg member 112B in the same direction as the first retention member 120, with either or both of the retention members 120, 122 being configured to retain shelf member 150 in a desired angular position with respect to the structural member 204. Furthermore, in some embodiments, clip member 106 may comprise at least one tab portion 124 configured to operably engage side wall 202 so as to provide a stop mechanism for preventing shelf member 150 from further rotating, when shelf member 150 is moved to the substantially horizontal deployed position. That is, the at least one tab portion 124 engages at least one of the wire members forming the side wall 202 of the rack 200 to provide a positive stop for the shelf member 150 at the deployed position, while allowing the shelf member 150 to be rotated back toward the stowed position. Preferably, the engagement between the at least one tab portion 124 and the at least one wire member is sufficiently robust so as to allow the shelf member 150 to support a determined capacity of dishware with respect to the dishwasher rack 200.

Advantageously, as shown in FIGS. 2-7, shelf member 150 of shelf accessory 100 may be movable in an "on-demand" manner to a plurality of discrete angular positions with respect to and about the structural member 204 of dishwasher rack 200, as needed. As previously disclosed, the discrete angular positions may include a substantially vertical stowed position, a substantially horizontal deployed position, and an intermediate position between the stowed position and the deployed position.

Figure 2:
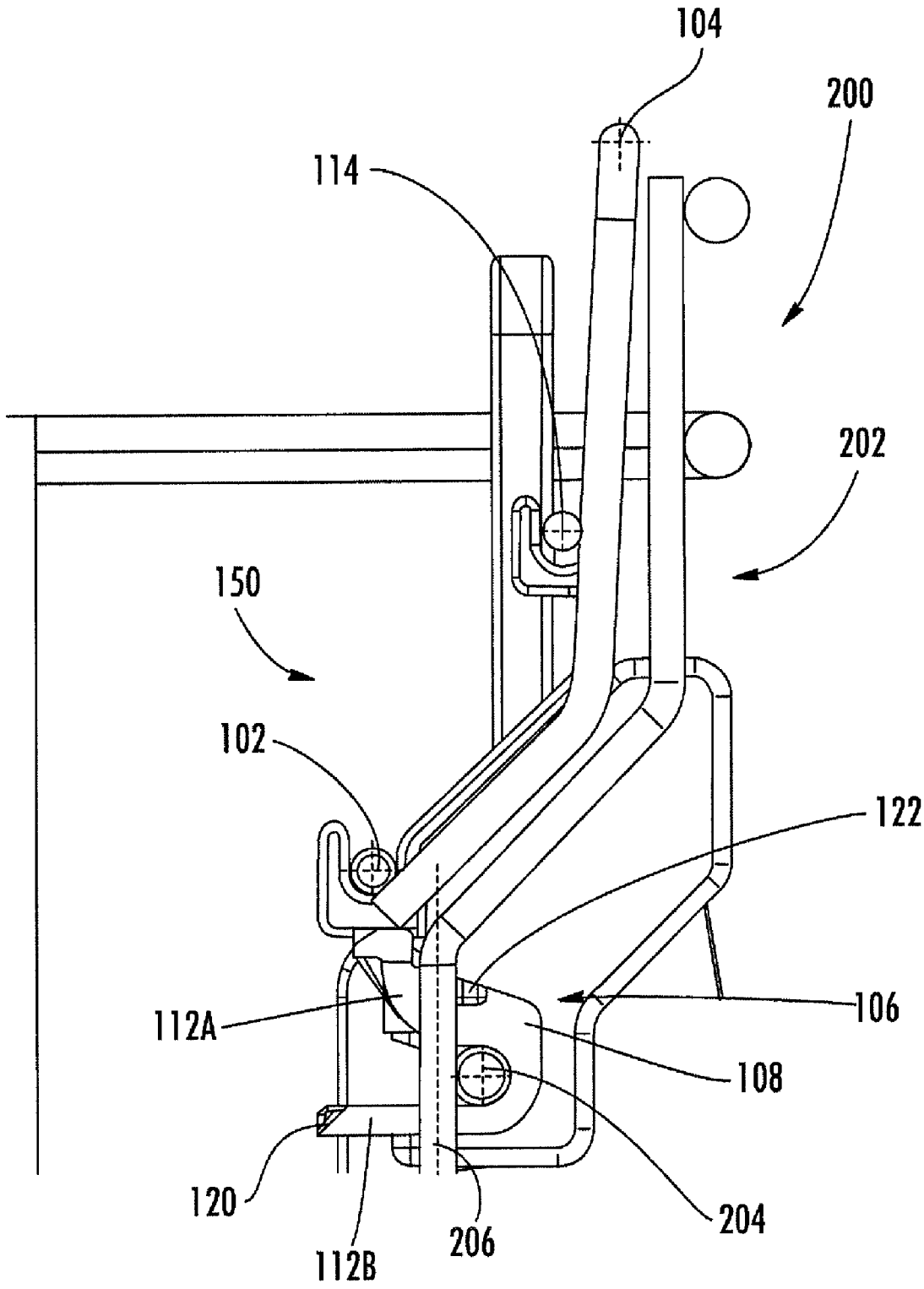
FIG. 2 illustrates a cross-sectional side view of a shelf accessory engaging a structural member of a dishwasher rack in a stowed position according to the present disclosure.
Figure 3:
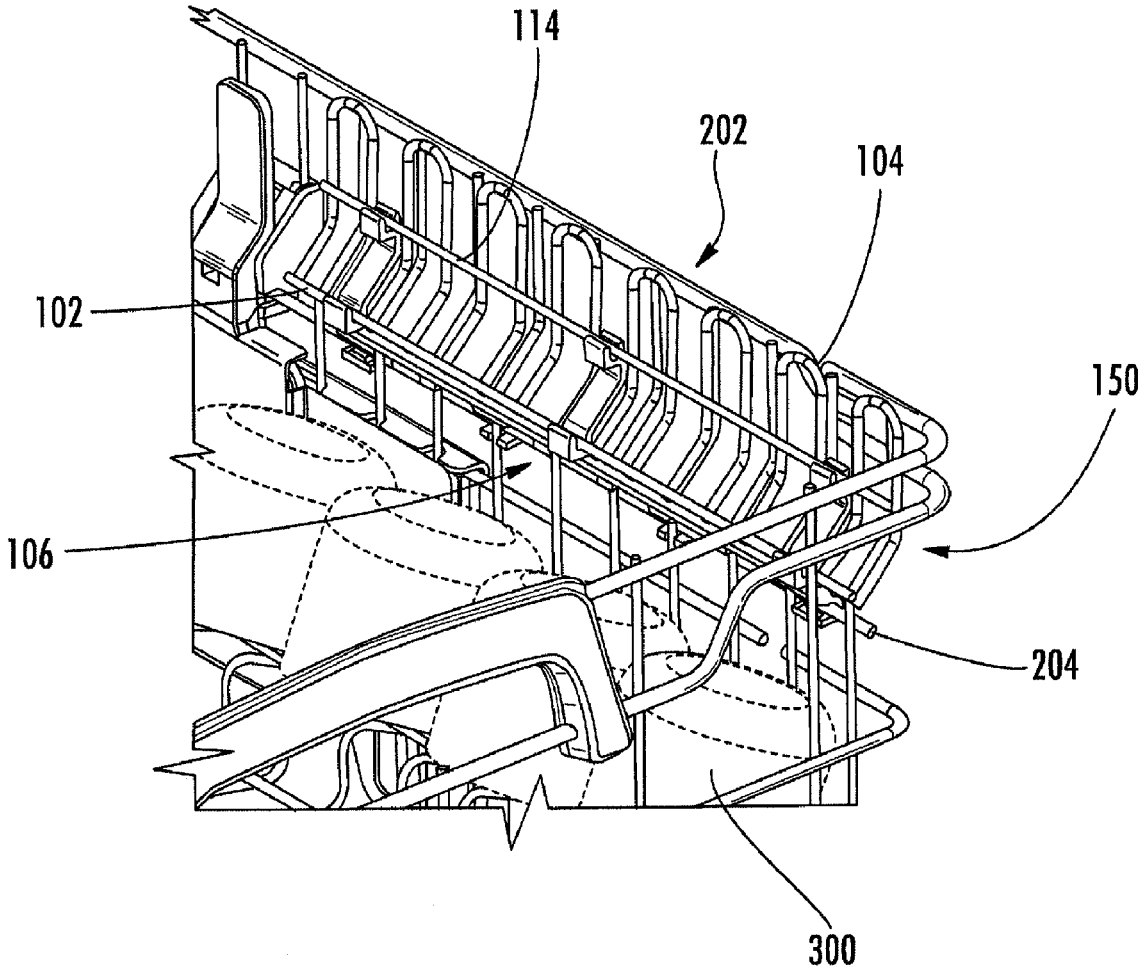
FIG. 3 illustrates a perspective view of a shelf accessory engaging a structural member of a dishwasher rack in a stowed position according to the present disclosure.

As shown in FIGS. 2-3, shelf member 150 may be retained in a "closed" or substantially vertical stowed position in which loops 104 are substantially vertical with respect to, for example, side wall 202. As mentioned previously, loops 104 may be angled or otherwise shaped or configured to conform to side wall 202 such that shelf member 150 does not protrude or otherwise minimally protrudes into the volume of dishwasher rack 200. Thus, with the shelf member 150 in the stowed position, dishware should preferably be insertable into the dishwasher rack 200 without interference from the shelf accessory 100. Because the side wall 202 may have a variety of different shapes such as shown, for example, in FIG. 2, loops 104 may be configured in any cooperating manner to maximize the open nature of dishwasher rack 200. That is, the loops 104 may be configured according to vertical spaces defined by the side wall 202 and to fit between certain vertically-oriented members of the side wall 202 when the shelf accessory 150 is in the stowed or storage position. In order to retain and support shelf member 150 in the stowed position, the first retention member 120 extending laterally from leg member 112A may engage an adjacently-disposed vertical tine 206 of side wall 202, for example, in an interference, friction, snap, or other appropriate fit, so as to prevent shelf member 150 from rotating toward the interior of dishwasher 200 (i.e., toward the intermediate angled position or substantially horizontal deployed position).

Figure 4:
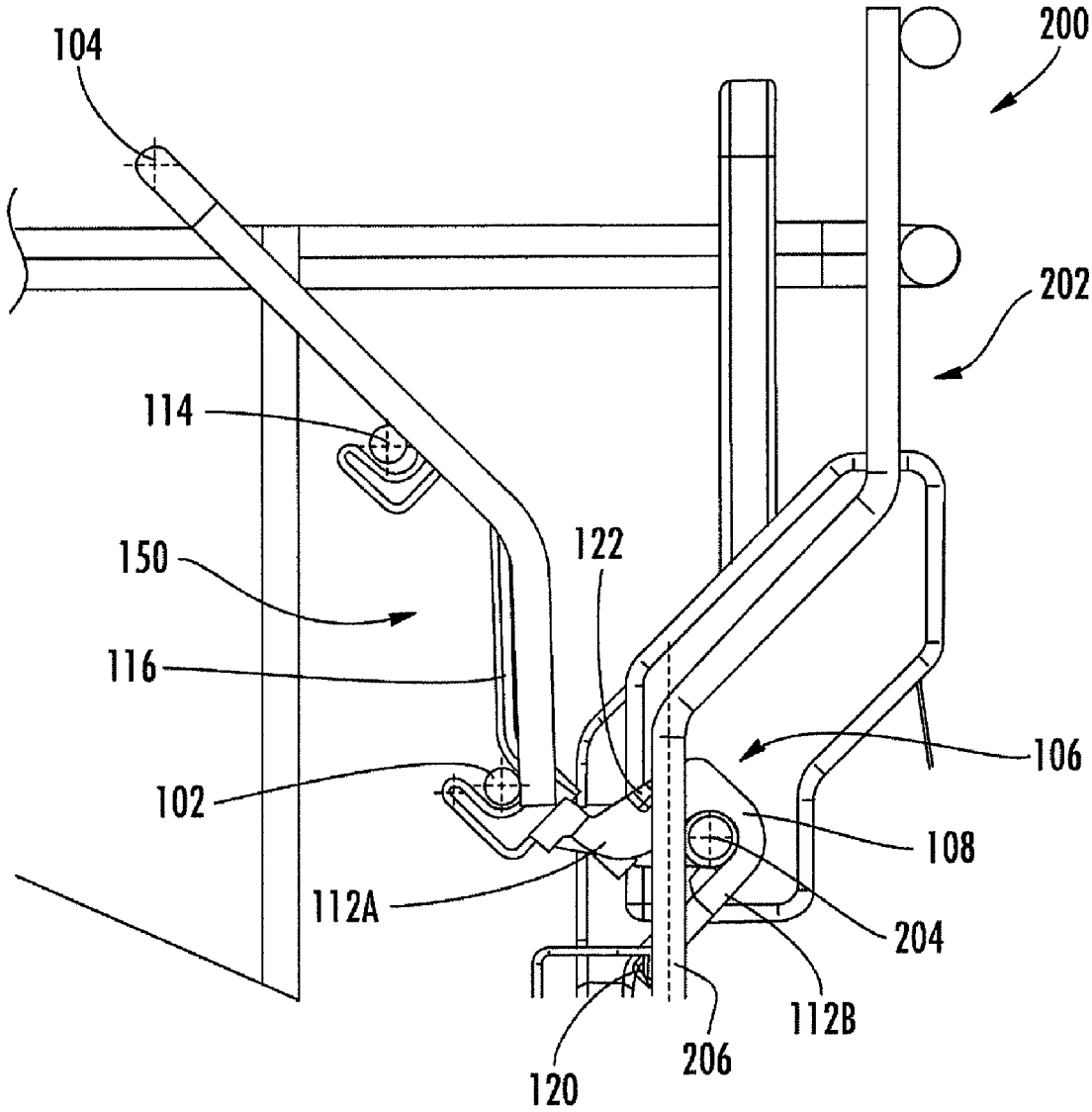
FIG. 4 illustrates a cross-sectional side view of a shelf accessory engaging a structural member of a dishwasher rack in an angled position according to the present disclosure.

As shown in FIG. 4, shelf member 150 may be rotated from the stowed position toward the interior of dishwasher rack 200 (i.e., toward the intermediate angled position or substantially horizontal deployed position). In one particular embodiment, shelf member 150 in the intermediate angled position is configured to extend, for example, at about a 45 degree angle with respect to side wall 202 of dishwasher rack 200, toward the interior thereof. However, this angle is designated for exemplary purposes only, and may be more than or less than 45 degrees. In any case, the angle of the intermediate position may be any angle between the stowed position and the deployed position. When supported in the intermediate position, according to some embodiments, loops 104 of shelf member 150 may be adapted to receive and laterally support therebetween, a stem portion of a stemware item, as previously discussed. To retain the shelf member 150 at the intermediate angled position, first retention member 120 and/or second retention member 122 may be configured to interact with the adjacent vertical tine 206 of side wall 202 to provide the necessary retention force or mechanism. For example, during rotation of shelf member 150 from the stowed position to the intermediate position, the first retention member 120 may be forcefully disengaged (i.e., by unsnapping, or overcoming friction or interference) from the adjacent vertical tine 206 of side wall 202 (the stowed position) and then moved toward the interior of the dishwasher rack 200. As shown, as clip member 106 rotates about rack spine 204, second retention member 122 extending from the other leg member 112B moves against and engages vertical tine 206 of side wall 202 (for example, in an interference, friction, snap, or other appropriate fit), to prevent further rotation of shelf member 150 toward the interior of dishwasher rack 200. In some instances, the first retention member 120 may also remain in engagement with the adjacent vertical tine 206 (albeit on an opposing side of the vertical tine 206 in the direction of rotation of the shelf member 150), for example, to prevent the shelf member 150 from readily rotating back to the stowed position.

Figure 5:
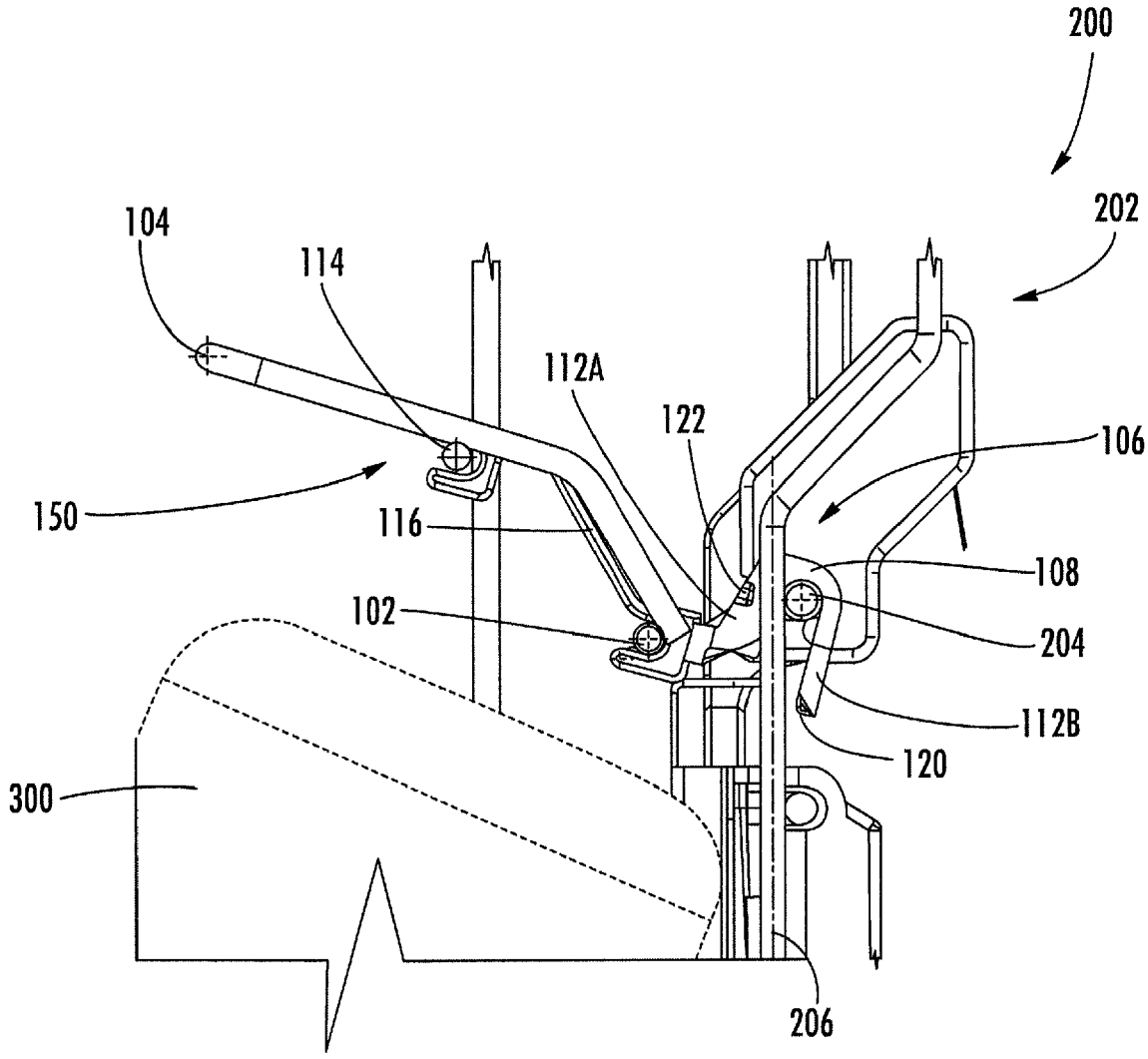
FIG. 5 illustrates a cross-sectional side view of a shelf accessory engaging a structural member of a dishwasher rack in a deployed position according to the present disclosure.
Figure 6:
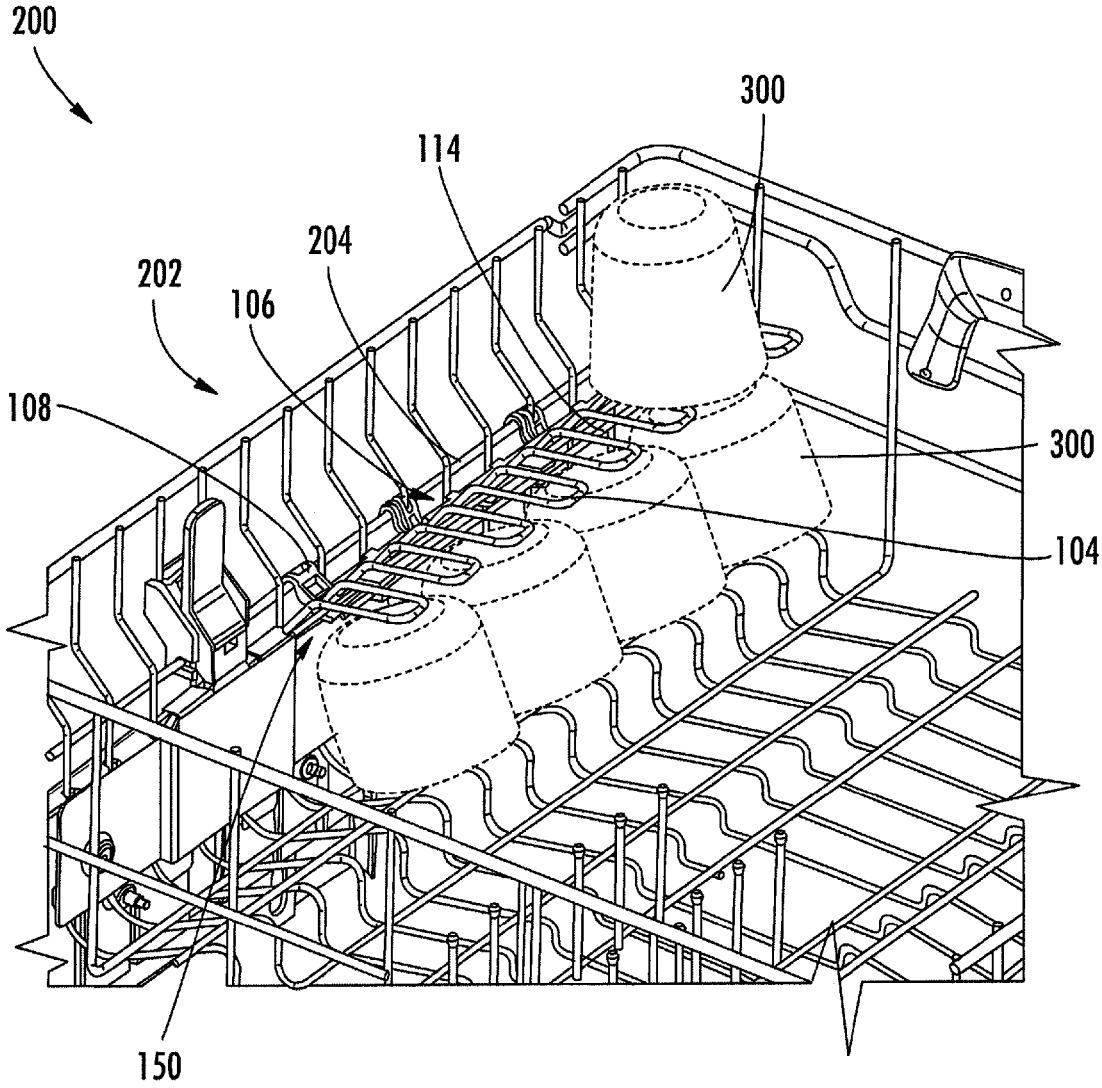
FIG. 6 illustrates a perspective view of a shelf accessory engaging a structural member of a dishwasher rack in a deployed position according to the present disclosure.
Figure 7:
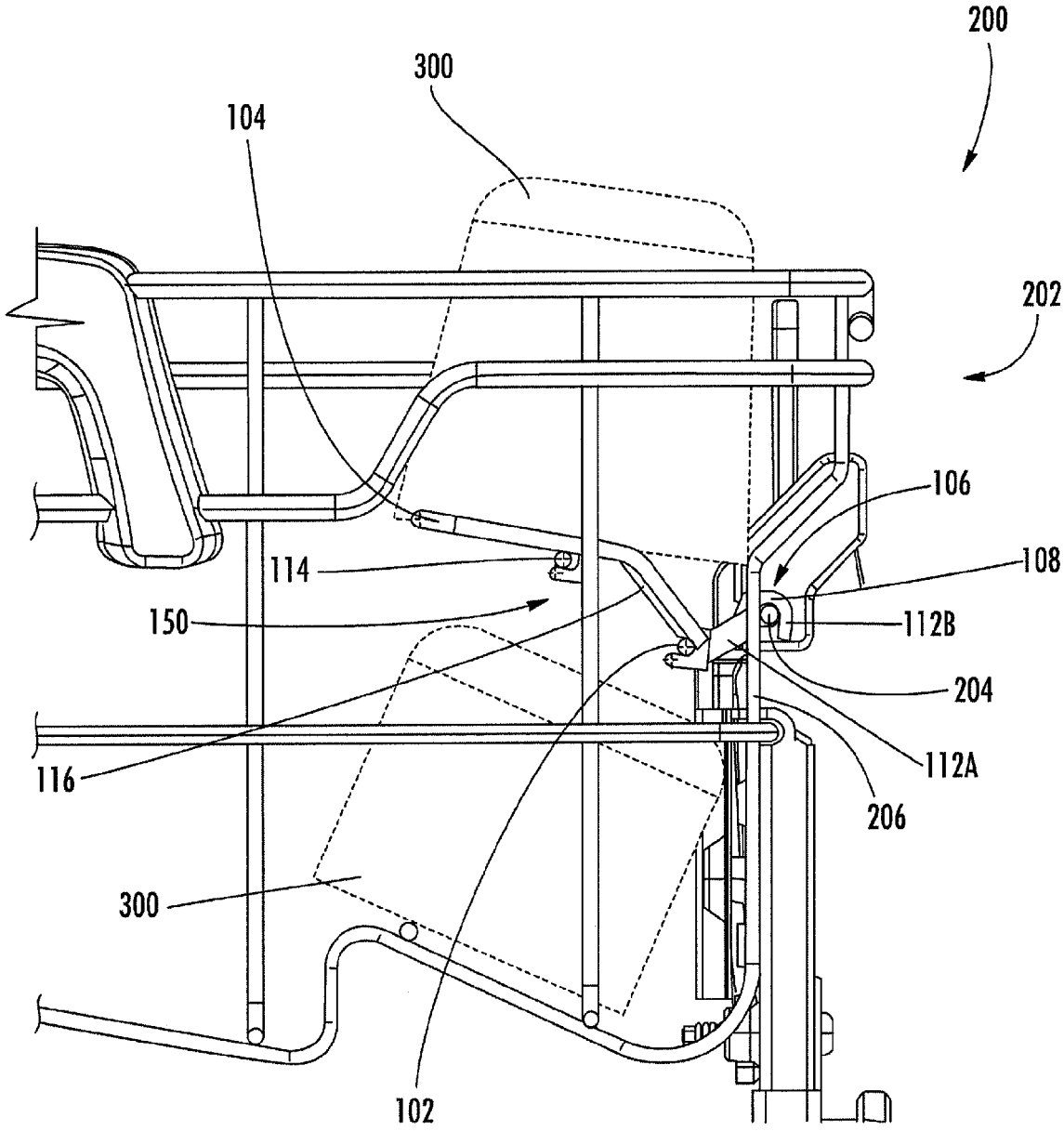
FIG. 7 illustrates a partial elevation view of a dishwasher rack having a shelf accessory engaged thereto in a deployed position for facilitating stacking of dishware according to the present disclosure.

As shown in FIGS. 5-7, the shelf member 150 may be configured to be further rotated toward the interior of dishwasher rack 200 to a fully deployed position, as previously discussed. In such a position, at least a portion of the loops 104 may be, for example, substantially horizontal with respect to the dishwasher rack 200 to thereby form a tiered structure, with the dishwasher rack 200 itself providing a first tier for receiving dishware, and the shelf member 150 providing a second tier for supporting additional dishware over the first tier. In one embodiment, at least a portion of each loop 104 extends from spine 102 at an angle of between about 15 degrees and about 20 degrees with respect to side wall 202 of dishwasher rack 200, toward the interior thereof. That is, an initial portion of each loop 104 extends from spine 102 at a particular angle, while a distal portion of each loop 104 then extends at a different angle with respect to the initial portion such that, when the loops 104 are in the deployed position, the distal portions thereof are substantially horizontal. The angle of the initial portion of each loop 104 is designated herein for exemplary purposes only, and may be more than or less than the recited 15-20 degrees. Accordingly, relatively short dishware 300 such as, for example, short high ball glasses may be positioned on the bottom of dishwasher rack 200, under the shelf member 150, and then additional glassware 300 placed on the shelf member 150 in the deployed position, whereby the glassware stacked on both tiers more efficiently utilizes the available capacity of the dishwasher rack 200, as illustrated in FIGS. 6 and 7.

During rotation of shelf member 150 from the intermediate position to the deployed position, the second retention member 122 may be forcefully disengaged (i.e., by unsnapping, or overcoming friction or interference) from the adjacent vertical tine 206 of side wall 202 (the intermediate position) and then moved further toward the interior of the dishwasher rack 200. In the deployed position, different mechanisms may be employed to prevent further rotation of the shelf member 150, as will be appreciated by one skilled in the art, wherein such a mechanism may not necessarily involve the at least one retention member 116. For example, a portion of the at least one securement member 108 may be configured with an interference fit with respect to another structural member of the side wall 202 as the shelf member is directed to the deployed position, wherein such an interference fit prevents further rotation of the shelf member 150 while providing support for the shelf member 150 should glassware 300 be placed thereon. In another example, clip member 106 may comprise at least one tab portion 124 (FIG. 1) configured to interact with corresponding vertical tine 206 of the side wall 202 so as to provide a stop mechanism for preventing shelf member 150 from further rotating toward the interior of the rack 200, when shelf member 150 is moved to the substantially horizontal deployed position. Preferably, the engagement between the at least one tab portion 124 and corresponding vertical tine 206 is sufficiently robust so as to allow the shelf member 150 to support a determined capacity of dishware with respect to the dishwasher rack 200.

Many modifications and other embodiments of the inventions set forth herein will come to mind to one skilled in the art to which these inventions pertain having the benefit of the teachings presented in the foregoing descriptions and the associated drawings. For example, one skilled in the art will appreciate that the same mechanisms involved in rotating the shelf member from the stowed position to the intermediate position, and further to the deployed position, may also be involved in returning the shelf member to either the intermediate position or the stowed position, though other mechanisms may be additionally or alternately involved. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An appliance, comprising:

a rack adapted to receive and support dishware therein, the rack having a plurality of structural members, including at least one laterally-extending structural member; and a shelf accessory operably engaged with the at least one laterally-extending structural member, the shelf accessory comprising:

a spine configured to extend in parallel with the at least one laterally-extending structural member;

a plurality of loops engaged with the spine and extending perpendicularly therefrom, the loops being spaced apart in relation to each other along the spine and cooperating therewith to define a shelf member; and a clip member operably engaged between the shelf member and the at least one laterally-extending structural member, the clip member having a first portion rigidly engaged with the shelf member and a second portion rotatably engaged with the at least one laterally-extending structural member, the clip member thereby being capable of rotating about the at least one laterally-extending structural member to cause the shelf member to correspondingly orbit about the at least one laterally-extending structural member, the clip member further comprising at least one retention member integrally formed therewith, the at least one retention member being configured to engage at least one of the plurality of structural members not including the at least one laterally-extending structural member of the rack, as the clip member is rotated about the at least one laterally-extending structural member, so as to retain and support the shelf member in at least one of a plurality of angular positions with respect to and about the at least one laterally-extending structural member.

2. An appliance according to claim 1, wherein the clip member is further configured such that the shelf member is movable between a substantially vertical angular position and a substantially horizontal angular position about the at least one laterally-extending structural member of the rack.

3. An appliance according to claim 2, wherein the shelf member in the substantially horizontal angular position divides a height of the rack, whereby the shelf member and the rack below the shelf member are both adapted to support the dishware.

4. An appliance according to claim 1, wherein the at least one retention member is configured to engage the rack so as to support the shelf member in one of a plurality of discrete angular positions about the at least one laterally-extending structural member, the discrete angular positions including a substantially vertical stowed position, a substantially horizontal deployed position, and an intermediate position between the stowed position and the deployed position.

5. An appliance according to claim 4, wherein the loops of the shelf member are adapted to receive and laterally support therebetween a stem portion of a stemware item, when the shelf member is supported in the intermediate position.

6. An appliance according to claim 1, wherein the clip member is operably engaged with the shelf member such that the shelf member is secured to and substantially immobile with respect to the clip member.

7. An appliance according to claim 1, further comprising a reinforcing member spaced apart from and extending substantially parallel to the spine, the reinforcing member intersecting and engaging the loops so as to maintain the spaced-apart relation therebetween.

8. An appliance according to claim 7, wherein the clip member extends from the at least one laterally-extending structural member and is configured to engage both the spine and the reinforcing member so as to support the shelf member with respect to the structural member.

9. An appliance according to claim 8, wherein the clip member further comprises at least one retention clip, the at least one retention clip engaging at least one of the spine, the reinforcing member, and one of the loops so as to secure the shelf member to the clip member.

10. An appliance according to claim 1, wherein the second portion of the clip member is rotatably engaged with the at least one laterally-extending structural member via at least one securement member configured to engage the at least one laterally-extending structural member, the at least one securement member comprising an open channel defined by opposing and spaced apart leg members, with one leg member extending to and engaging the shelf member, the leg members being configured to receive and secure the at least one laterally-extending structural member therebetween such that the clip member is rotatable thereabout.

11. An appliance according to claim 10, wherein the at least one retention member comprises a plurality of retention members, wherein each of the leg members includes at least one of the plurality of retention members disposed on a laterally-oriented surface thereof such that the at least one of the plurality of retention members extends substantially parallel with the at least one laterally-extending structural member, the at least one of the plurality of retention members being configured to engage a laterally-adjacent member of the rack as the clip member is rotated about the at least one laterally-extending structural member, so as to retain and support the shelf member in the at least one the plurality of angular positions with respect to and about the at least one laterally-extending structural member.

* * * * *